United States Patent [19]

Bell

[11] Patent Number: 4,716,599

[45] Date of Patent: Jan. 5, 1988

[54] REVERSIBLE CAP USED AS NAVIGATIONAL AID

[75] Inventor: Richard S. Bell, Gloucester, Mass.

[73] Assignee: Mighty-Mac, Inc., Gloucester, Mass.

[21] Appl. No.: 335,324

[22] Filed: Dec. 28, 1981

[51] Int. Cl.[4] ..... A42B 1/04

[52] U.S. Cl. ..... 2/195; 2/196

[58] Field of Search ..... 2/209.1, 196, 186, 195, 2/DIG. 2

[56] References Cited

U.S. PATENT DOCUMENTS

| | | | |
|---|---|---|---|
| 16,972 | 4/1926 | Epstein | 2/DIG. 2 |
| 1,111,659 | 9/1914 | Pierre | 2/196 X |
| 1,816,346 | 7/1931 | Silverstein | 2/195 |
| 2,420,569 | 5/1947 | Sewell | 2/195 |
| 2,597,447 | 5/1952 | Bruns | 2/209.1 |
| 2,874,387 | 2/1959 | Bannister et al. | 2/195 |
| 2,883,669 | 4/1959 | Rafowitz et al. | 2/195 |

FOREIGN PATENT DOCUMENTS

| | | | |
|---|---|---|---|
| 461664 | 6/1928 | Fed. Rep. of Germany | 2/195 |
| 440545 | 7/1912 | France | 2/195 |

*Primary Examiner*—Werner H. Schroeder

*Attorney, Agent, or Firm*—Fleit, Jacobson, Cohn & Price

[57] ABSTRACT

An invertible head cover in the form of a cap is provided including a flexible crown portion, a head encircling band portion extending about the open side of the crown portion and a visor portion supported and projecting forwardly from the front marginal portion of the head encircling band portion. The head cover inner and outer surfaces on opposite sides of a vertical front to rear extending plane bisecting the hat are of different colors and the color of the inner and outer surfaces of the cap on a first side of the aforementioned plane are red and the inner and outer surfaces of the hat on the other side of the plane are black. The visor portion of the cap projects forwardly of the forward marginal portion of the head encircling band portion of the cap a distance sufficient for normal upper peripheral vision of the wearer of the cap, while looking straight ahead, to view the opposite side undersurface portions of the visor portion, even when the cap is worn on the back of the head with the visor portion disposed in a forwardly and upwardly inclined position. The outer and inner surfaces of the forward crown portion of the cap include indicia indicating upstream and downstream directions, respectively, the downstream direction indicia being disposed for viewing by a person disposed to the front of the cap when the cap is worn with the red side thereof to the left of the wearer.

11 Claims, 3 Drawing Figures

FIG. 1
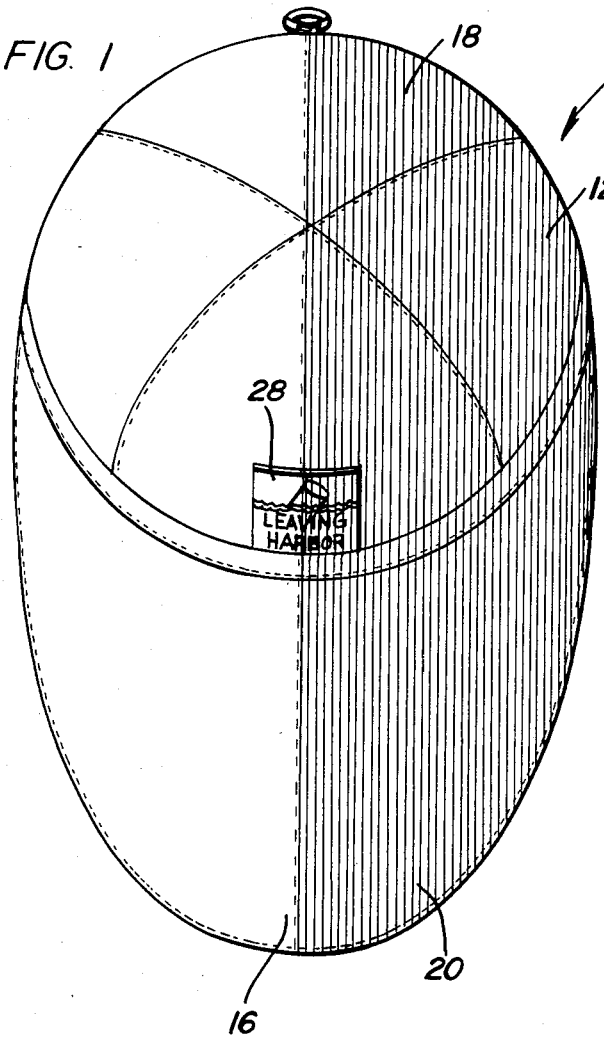
FIG. 2
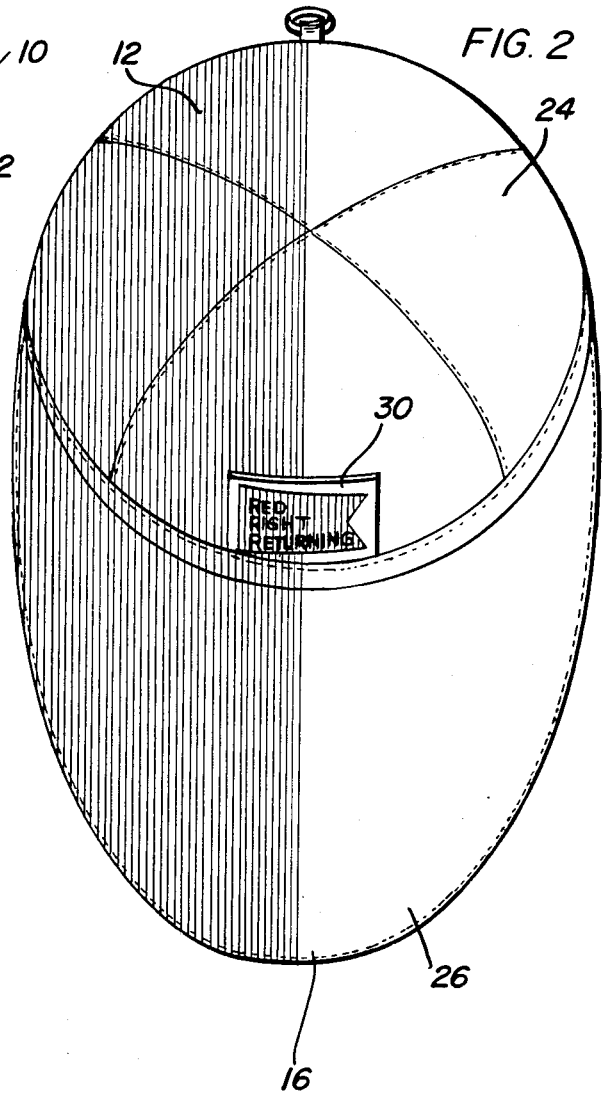
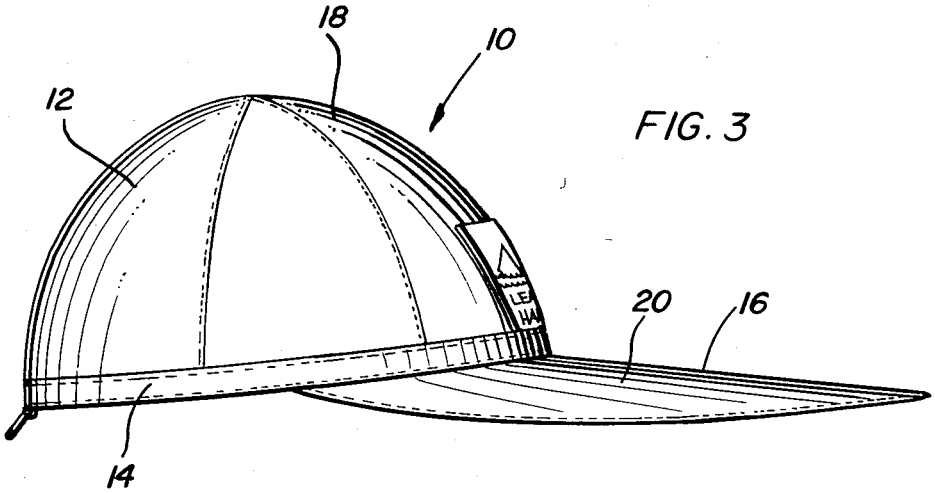
FIG. 3

REVERSIBLE CAP USED AS NAVIGATIONAL AID

BACKGROUND OF THE INVENTION

Various methods are used by persons navigating ships in both upstream and downstream directions to establish the sides of the ship upon which red and black buoys are to be passed. Although confusion may seldom occur as to which side of a buoy is to be passed by a ship when the helmsman of the ship is not hurried in his decision, there are many instances, especially in crowded waterways, which require a helmsman to make a quick decision as to which side of his vessel a red or black buoy being passed is to be disposed.

Many helmsmen refer to the phrase "red, right, return" which indicates that a red buoy is to be taken on the right side of the vessel when travelling upstream and, therefore, that a black buoy is to be taken on the left side when travelling upstream and that red and black buoys are to be taken on the left and right sides, respectively, when moving downstream. However, many persons who navigate private boats become confused and take buoys on the wrong side. Such action can result in a ship running aground and various degrees of damage to the hull of the ship. Accordingly, a need exists for a means by which even an unexperienced helmsman may be afforded a rapid reference to indicate the side of the ship upon which both red and black buoys are to be taken.

Examples of reversible cap and hat structures including some of the general structural features of the instant invention are disclosed in U.S. Pat. Nos. 1,598,379, 1,648,551, 1,658,590 and 1,816,346.

BRIEF DESCRIPTION OF THE INVENTION

The cap of the instant invention is invertible and includes a generally partially spherical crown portion including a head encircling band portion extending about the open side of the crown portion. In addition, the cap includes a forwardly projecting bill portion supported from the forward marginal portion of the crown portion. The inner and outer surfaces of the crown portion and the upper and lower surfaces of the bill portion include opposite side surface areas disposed to opposite sides of a front-to-rear extending central vertical plane and the surface positions disposed on one side of the plane are red and the surface portions disposed on the other side of the plane are black. The forwardly extending bill portion is of an extended length whereby the red and black opposite side undersurface portions thereof may be readily viewed as a result of the normal upward peripheral vision of a person wearing the cap. Further, inasmuch as the cap is invertible, the red and black undersurface portions of the bill of the cap may be reversed upon removal of the cap from the wearer and replacement of the cap on the head of the wearer in an inverted position.

The cap is to be used with the red and black opposite side undersurface portions of the bill portion of the cap disposed on the left and right when an associated boat is moving downstream and with the red and black undersurface portions disposed on the right and left sides when the associated boat is moving upstream. In this manner, upward peripheral vision of the wearer of the cap will immediately indicate to the wearer the side of the boat upon which red and black buoys are to be passed.

The main object of this invention is to provide the helmsman of a boat immediate reference to that side of the boat on which a red or black buoy is to be passed.

Another object of this invention is to provide the helmsman of a boat with an apparatus in accordance with the immediately preceding object and which may be reversed according to whether the boat is moving in an upstream or downstream direction.

Yet another object of this invention is to provide an apparatus in accordance with the preceding objects in the form of a cap which may be conveniently worn on the head of a helmsman.

Still another important object of this invention is to provide a cap which will indicate to persons viewing the hat from the exterior thereof of whether the helmsman of the boat has the hat properly positioned on his head according to whether the boat is moving in an upstream or downstream direction.

Yet another object of this invention is to provide an apparatus in accordance with the preceding objects and which will conform to conventional forms of manufacture, be of simple construction and substantially automatic in operation, so as to provide a device that will be economically feasible, long lasting and substantially trouble-free.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a top plan view of the hat with the red and black colored portions thereof positioned to indicate the sides of an associated boat upon which red and black buoys are to be passed;

FIG. 2 is a top plan view of the hat in an inverted position; and

FIG. 3 is a side elevational view of the hat illustration in FIG. 1.

DETAILED DESCRIPTION OF THE INVENTION

Referring now more specifically to the drawings, the numeral 10 generally designates a hat constructed in accordance with the present invention. The hat 10 is in the form of a cap and includes a generally hemispherical crown portion 12 having a head encircling band portion 14 secured to and extending about the open side of the crown portion 12. A forwardly projecting visor portion 16 is secured to and projects forwardly from the forward marginal portion of the head encircling band portion 14.

The crown portion and head band portion are flexible and may be inverted and while the visor portion 16 is also somewhat flexible, it is internally stiffened, at least to some degree.

Considering the cap as illustrated in FIGS. 1 and 3, the crown portion includes an outer surface 18 and the visor portion 16 includes an upper surface 20. In addition, the crown portion includes an inner surface 24 and the visor portion includes an undersurface 26, the surfaces 24 and 26 being disposed to the outer and upper sides in FIG. 2.

The surfaces 18 and 20 as well as the surfaces 24 and 26 include opposite side areas disposed on opposite sides of a vertical plane passing in a front-to-rear direction centrally through the cap 10. The side areas of the surfaces 18 and 20 shown on the hat 10 in FIG. 1 and disposed to the left of the front-to-rear extending plane are colored red as are the corresponding side areas of the surfaces 24 and 26. The side areas of the surfaces 18 and 20 disposed to the right of the aforementioned plane are black as are the corresponding side areas of the surfaces 24 and 26. However, as may be appreciated from a comparison of FIGS. 1 and 2 of the drawings, while the red side areas of the surfaces 18, 20, 24 and 26 are disposed on the left hand side of the hat illustrated in FIG. 1 when the hat 10 is inverted, the red side areas of the surfaces 18, 20, 24 and 26 are disposed on the right side of the aforementioned plane.

With attention again invited to FIGS. 1 and 2, the outer side of the forward portion of the crown portion 12 illustrated in FIG. 1 includes a tag 28 secured thereon including the indicia "LEAVING HARBOR" and the opposite side of the forward portion of the crown portion 12 includes a tag 30 thereon with the indicia "RED RIGHT RETURNING" thereon.

Thus, when the hat or cap 10 is worn with the tag 28 exposed on the front side of the cap portion 12, the left underside portion of the visor portion 16 is red indicating that red buoy should be taken on the left side of the boat and black buoy should be taken on the right side of the boat when the boat is moving downstream. However, when the cap is inverted in the manner illustrated in FIG. 2 of the drawings with the tag 30 exposed on the front side of the crown portion 12, the right side of the underside of the visor portion is red while the left side of the underside of the visor portion is black. This indicates that when returning upstream the red buoys are to be taken on the right side of the boat and the black buoys are to be taken on the left side of the boat.

The length of the visor portion 16 is sufficient whereby when the wearer of the hat 10 is looking straight forward the red and black underside portions of the visor portion 16 may be readily viewable as a result of upper peripheral vision. The length of the visor portion 16 is sufficient to the extent that such upper peripheral vision may be effective to determine the red and black underside portions of the visor 16, even when the crown portion 12 is worn on the back of the head and the visor portion 16 is forwardly and upwardly inclined. Also, the aforementioned upper peripheral vision is also effective, due to the length of the visor portion 16, to view the red and black underside portions of the visor 16 through the upper portions of conventional eyeglasses worn by the wearer of the hat 10, with such upper, peripheral vision being effected through the upper lens portions of a pair of glasses worn by the wearer of the hat 10 below the upper frame of the glasses.

By utilizing the hat of the instant invention, a helmsman need only to change to the right side of the hat according to whether his boat is moving in a downstream direction or in an upstream direction. While moving in such directions, required rapid decisions as to which side of a red or black buoy to pass may be readily accomplished merely by the helmsman viewing the corresponding colored portion of the underside of the visor portion 16.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A hat for assisting in navigation by indicating the side of the vessel on which red and black buoys are to be passed, said hat including a flexible invertible crown portion, a head encircling band portion extending about the open side of the crown portion and a visor portion supported and projecting forwardly from the front marginal portion of the head encircling band portion, said visor portion including upper and lower surfaces, said upper and lower surfaces each including first and second opposite side portions, the upper and lower surfaces of the first side portion of said visor portion being red in color and the upper and lower surfaces of the second side portion of said visor portion being black in color.

2. The hat of claim 1 wherein said crown portion includes outer and inner surfaces and each outer and inner surface includes first and second opposite side portions corresponding to the first and second side portions of said visor portion, the outer and inner surfaces of said crown portion first side portion being red in color and the inner and outer surfaces of said crown portion second side portion being black in color.

3. The hat of claim 2 wherein said opposite side portions of said upper and lower surfaces and the opposite side portions of said outer and inner surfaces are defined on and comprise at least a major portion of each of said surfaces disposed on the corresponding side of a front-to-rear extending vertical plane substantially bisecting said hat into equal opposite side portions.

4. The hat of claim 3 wherein said visor portion projects forwardly of the front portion of said head encircling band portion a distance for normal upper peripheral vision of the wearer, while looking straight ahead, of said hat to enable viewing of the opposite side undersurface portions of said visor portion, even when the hat is worn on the back of the head with the visor portion disposed in a forwardly and upwardly inclined position.

5. The hat of claim 1 wherein said first and second sides of said upper surface comprise the left and right sides of said visor.

6. The hat of claim 5 wherein the forward portion of the outer and inner sides of said crown portion includes means indicating downstream and upstream movement, respectively.

7. The hat of claim 6 wherein said crown portion includes outer and inner surfaces and each outer and inner surface includes first and second opposite side portions corresponding to the first and second side portions of said visor portion, the outer and inner surfaces of said crown portion first side portion being red in color and the inner and outer surfaces of said crown portion second side portion being black in color.

8. The hat of claim 7 wherein said opposite side portions of said upper and lower surfaces and the opposite side portions of said outer and inner surfaces are defined on and comprise at least a major portion of each of said surfaces disposed on the corresponding side of a front-to-rear extending vertical plane substantially bisecting said hat into equal opposite side portions.

9. The hat of claim 8 wherein said visor portion projects forwardly of the front portion of said head encircling band portion a distance for normal upper peripheral vision of the wearer, while looking straight ahead, of said hat to enable viewing of the opposite side undersurface portions of said visor portion, even when the hat is worn on the back of the head with the visor portion disposed in a forwardly and upwardly inclined position.

10. The hat of claim 1 wherein said visor portion projects forwardly of the front portion of said head encircling band portion a distance for normal upper peripheral vision of the wearer, while looking straight ahead, of said hat to enable viewing of the opposite side undersurface portions of said visor portion, even when the hat is worn on the back of the head with the visor portion disposed in a forwardly and upwardly inclined position.

11. A hat for assisting in navigation by indicating the side of a vessel on which red and black buoys are to be passed, said hat including a flexible invertible crown portion, a head encircling band portion extending about the open side of the crown portion and a visor portion supported and projecting forwardly from the front marginal portion of the head encircling band portion, corresponding opposite side portions of the inner and outer surfaces of the crown portion, head encircling band portion and visor portion being of two different colors, said two different colors comprising red and black, the forward portion of the crown portion of said hat including indicia on the inner and outer surfaces thereof indicating upstream and downstream directions, the corresponding red inner and outer surfaces being disposed to the left side of the wearer of the hat when the hat is being worn with the downstream direction indicia is disposed on the outside of the crown portion.

* * * * *